United States Patent [19]

Bühler et al.

[11] 4,435,157

[45] Mar. 6, 1984

[54] HEAT EXCHANGER CONSTRUCTION AND METHOD OF OPERATION

[75] Inventors: Hans-Eugen Bühler, Königstein; Horst Kalfa, Frankfurt, both of Fed. Rep. of Germany

[73] Assignee: Brohltal-Deumag AG fur feuerfeste Erzeugnisse, Urmitz b. Koblenz, Fed. Rep. of Germany

[21] Appl. No.: 339,506

[22] Filed: Jan. 15, 1982

[30] Foreign Application Priority Data

Jan. 16, 1981 [DE] Fed. Rep. of Germany ..... 3101174

[51] Int. Cl.[3] ..... F24H 7/00; C22C 33/00; C21B 7/02; C21B 9/00

[52] U.S. Cl. ..... 432/30; 75/123 J; 266/286; 432/214; 432/216

[58] Field of Search ..... 432/30, 214, 216; 75/123 J; 266/286

[56] References Cited

U.S. PATENT DOCUMENTS 2,533,457 12/1950 Hasche ..... 432/30
4,003,695 1/1977 Kandakov et al. ..... 432/214
4,022,572 5/1977 Klein et al. ..... 432/214
4,222,772 9/1980 Sogo et al. ..... 75/124

FOREIGN PATENT DOCUMENTS 494841 11/1938 United Kingdom ..... 75/123 J

*Primary Examiner*—John J. Camby
*Attorney, Agent, or Firm*—Brian G. Brunsvold; Stephen L. Peterson; Everett H. Murray, Jr.

[57] ABSTRACT

A heat exchanger and especially a blast preheater (or cowper) for blast furnaces with refractory lining, insulating layer and steel jacket is described, the insulating layer of which is designed so that a steel jacket temperature of from 20° to 60° C. can be set and that said steel jacket is made of chromeless structural steel having a molybdenum content in the range from 0.01 to 2% by weight. The blast preheater (or cowper) has a prolonged service life and a low tendency to nitrate tension crack corrosion of the jacket sheet, for which reason it is very suitable for use in a process for the temperature control of gas and blast for the blast furnace. The process is suitable for blast preheaters (or cowpers) with external or internal combustion chamber or checker chamber and downstream collector ducts.

17 Claims, 6 Drawing Figures

Welding Data

Figure 6:
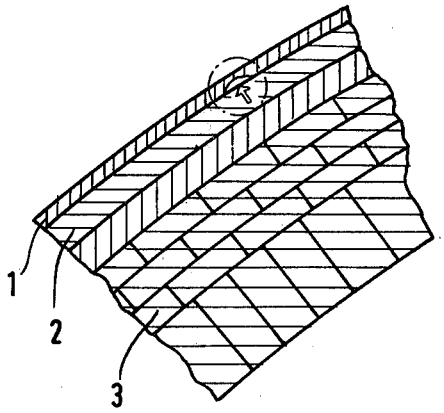

Steel : 15 Mo3
Sheet thickness : 20 mm
Seam preparation : 2/3 DV-seam 60°
Preheating : 120°C
Intermediate layer temp. : 120 - 150°C

| Welding Process | Bead Number | Layers No. | Layers +) Type | Elektr. Wire dmr mm | Current Amps. | Welding Voltage-Volts | Speed cm/min. | Heat applic. k Joule/cm | Intermediate Layer temp. |
|---|---|---|---|---|---|---|---|---|---|
| E-Hand | 1 | 1 | W | 3,25 | 100 | 20 | 4,5 | 26,6 | 120 |
| | 2 | 2 | F | 4 | 140 | 21 | 10,0 | 17,6 | 130 |
| | 3 | 3 | F | 3,25 | 100 | 20 | 7,5 | 16,0 | 140 |
| | 4 | 4 | D | 3,25 | 100 | 20 | 7,5 | 16,0 | 150 |
| | 5 | 5 | V | 3,25 | 100 | 20 | 6,0 | 20,0 | 150 |
| | | | | | | | | | |
| | 6 | 6 | G | 3,25 | 100 | 20 | 6,0 | 20,0 | 130 |
| | 7 | 7 | G | 3,25 | 100 | 20 | 7,5 | 16,0 | 140 |
| | 8 | 8 | D | 3,25 | 100 | 20 | 7,5 | 16,0 | 140 |
| | 9 | 9 | V | 3,25 | 100 | 20 | 8,0 | 15,0 | 150 |

+) W = rood-, F = fill-, D = cover- and G = cap passes
V = heat treatable layer

Weld build-up

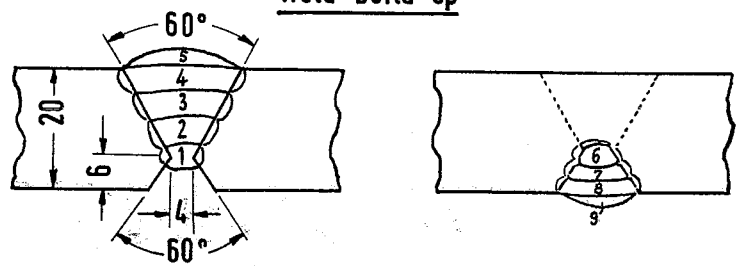

FIG. 1 Table of Welding data and illustration of weld build-up (seam build-up)

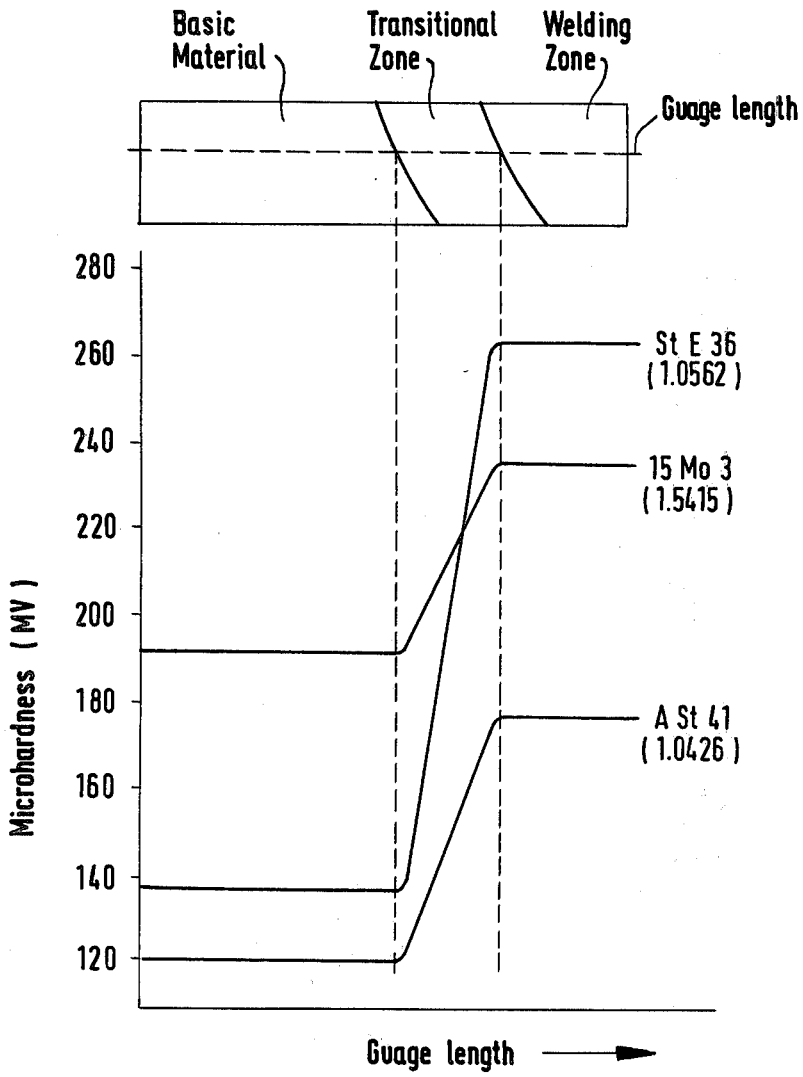
FIG. 2 Hardness graph in welding seam area for differing materials with welding of the same composition as the base

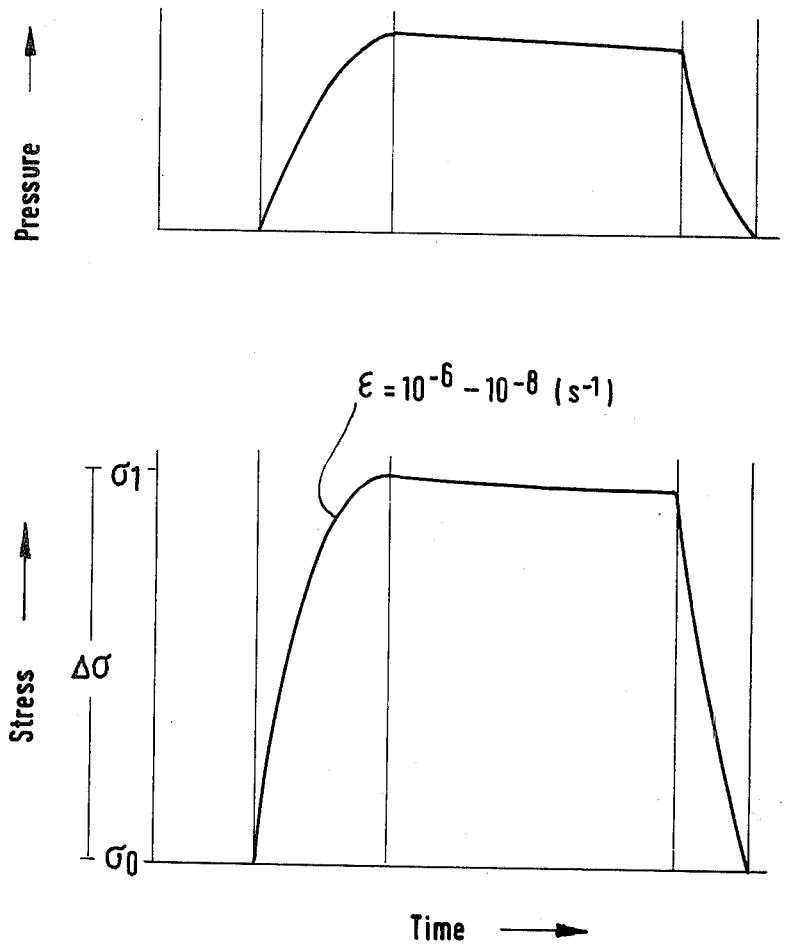
FIG. 3 Schematic illustration of the stress gradient in the jacket sheed with pressure changes of the blast preheater (or cowper )

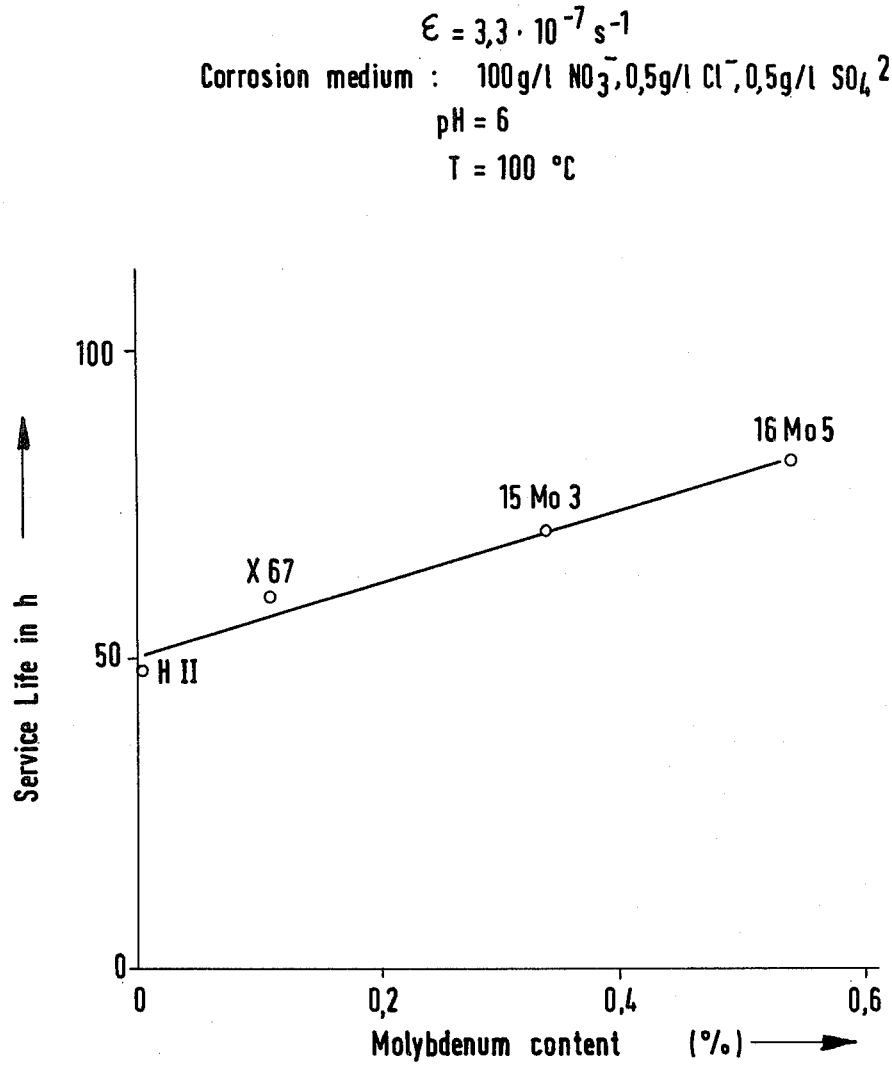
FIG. 4 Influence of the Mo-content on the tension crack stability in constant strain rate test

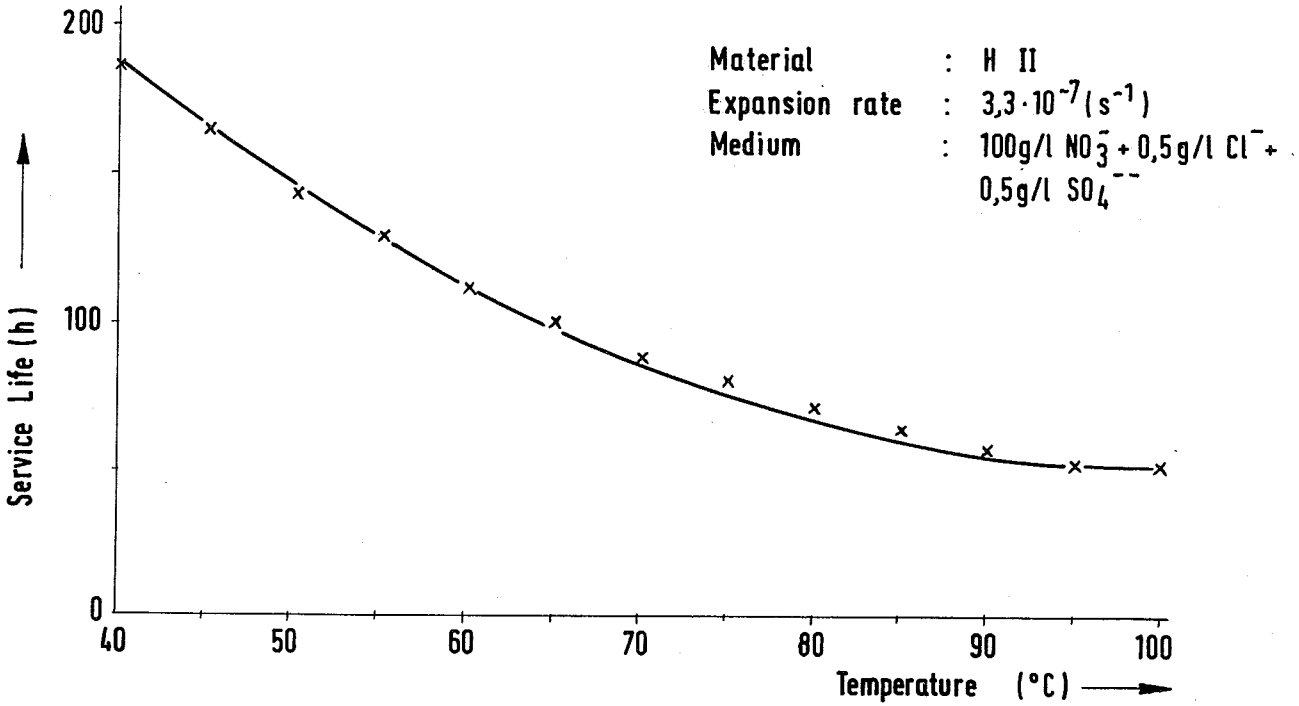
FIG. 5 Influence of temperature on service life in CSR tests

HEAT EXCHANGER CONSTRUCTION AND METHOD OF OPERATION

The invention concerns a heat exchanger, especially a blast preheater (or cowper) for blast furnaces, a process for the temperature regulation of gas and blast for the blast furnace, as well as the use of this process.

Heat exchangers and especially blast preheaters (or cowpers) for blast furnaces having a refractory lining, and inner insulation layer and a steel jacket or steel armor thereon are already known. In heat exchangers of the type named above, air or gas is to be transported at peak heating temperatures of more than 1000° C. Below the subject of the invention will be explained using the example of a blast preheater (or cowper) for the operation of blast furnaces.

In the inner chamber of blast preheaters, air compressed to a maximum of 4 bar is heated during passage through a refractory lining, which has been heated to temperatures of up to 1500° C. During this process the air reaches approximately the temperature of the refractory lining. The nitrogen component of the air reacts noticeably at temperatures above 1300° C. with the oxygen content to form nitric oxides. Since the refractory lining and the insulating layer are gas-permeable systems, the gas mixture of steam, nitric oxides and non-reacted air which is present in the inner chamber of the blast preheater (or cowper) reaches the steel jacket, where there may be temperatures in the vicinity of the condensation point of the gas mixture. If the condensation point of the gas mixture is attained at the steel jacket, which in practical use may happen in all the sections of the blast preheater (or cowper), a condensate is formed having high percentages of nitrate and/or nitrite ions.

From previous corrosion research it is known that tensile stress loaded structural steel structures tend to be subject to tension crack corrosion in the presence of nitrate electrolytes, especially with an acidic pH value. It is precisely the large scale welded installations such as blast preheaters which are especially endangered by tension crack corrosion with nitrate condensates present in their interiors on account of the high tension due to welding and the cyclical operation of the blast preheater (or cowper) in the gas- and heating phase.

The damage caused by tension crack corrosion is not limited to certain types of blast preheaters and the course of the damage is in many cases characterized in that the crack phenomena progress very rapidly after the first location thereof and the number of cracks and their depth soon compel the start of repairs of the installation. As a rule, a long incubation period is followed by a short cracking period.

Already a number of measures to avoid the damage have been taken and up to now the most promising appear to be an outer insulation to prevent the shortfall of the condensation point on the jacket sheet covering or the application of sealing foils or coatings on the interior of the jacket. But the external insuation, which was formerly the most effective means against tension crack corrosion had the result that the condensation of the nitrate gas phase only took place in the areas of the subsequent systems. Thus the tension crack corrosion cannot be avoided by the use of this method, it can only be locally displaced.

With all the measures previously taken to avoid tension crack corrosion, the point of departure was the influencing of only one aspect of the mechanism of tension crack corrosion. First attempts were made to remove the electrolytes from the corrosion system(sealing by foils or coatings and external insulation to prevent the attainment of the condensation point), and secondly efforts were made to develop constructional steels which have an adequate stability against tension crack corrosion because of their alloy composition. The last mentioned method was chosen in German laid open document No. 29 07 152 corresponding to U.S. Pat. No. 4,222,772. By the increase in the chromium and molybdenum contents and by the simultaneously lowering of the carbon content to values below 0.05%, attempts were made to increase the stability of constructional steels against tension crack corrosion. The laboratory examination of these special alloys for tension crack corrosion susceptibility was carried out according to the prior art at that time in a 60% calcium-nitrate solution with the addition of ammonium nitrate in a static corrosion test. But today's knowledge of corrosion testing shows that neither the corrosion medium nor the mechanical test method used correspond to the practical loads in industrial use, so that during the testing of the alloys listed in said document, no results usable in practice were achieved. U.S. Pat. No. 4,222,772 cites the service lives before the appearance of tension crack corrosion of two and a half years for the design made of these special alloys, which are unacceptable for the operators of blast preheater installations. On the contrary in this sector average service lives for the aggregate of at least 10 to 15 years are desirable.

The invention is based on the object of improving heat exchangers of the type named above and blast preheaters in particular, so that while avoiding or reducing intercrystalline tensile corrosion on the sheet covering, they can be operated with an increase in their previous service lives. A further aspect of this object is to create a process for the temperature regulation of gas and blast for blast furnaces, whereby this process is applicable to heat exchangers of any design according to the invention.

The object of the invention is attained in that by means of a complex intervention in the relevant influencing parameters of tension crack corrosion, the corresponding susceptibility of the heat exchanger can be reduced. This is attained according to the invention by the creation of a heat exchanger and especially of a blast preheater (or cowper) for blast furnaces of the type mentioned above which is characterized in that the insulating layer is so designed that in the operating conditions of the heat exchanger, a steel jacket temperature of 20° to 60° C. can be set, and that the steel jacket is made of chrome-free structural steel having a molybdenum content in the range from 0.01 to 2% by weight.

The process of the invention for the temperature regulation of gas and blast for blast furnaces is shown to be advantageous when gas or blast are led in the manner known per se through the blast preheater, which has a refractory lining, an intermediate insulating layer, and a sheet covering made of chrome-free structural steel with a molybdenum content of from 0.01 to 2% by weight, whereby the dimensions of the insulating layer and the operating conditions, e.g. including the throughput of the gaseous medium, are coordinated with each other so that the temperature of the sheet covering is below 60° C.

In the framework of the invention the use of chrome-free structural steel with the cited molybdenum content is especially advantageous when it has a high resistance to intercrystalline nitrate tension crack corrosion under conditions of oscillating, low frequency alternating loads. Depending on the type of steel being used, it may be advantageous if it does not contain any percentage of vanadium. Since high sheet covering temperatures lead to an accelerated process of tension crack corrosion when in certain areas of the blast preheater there is a shortfall in the condensation point temperature, according to the invention a rational influence is exerted on the temperature of the corrosion medium which may be present. Tests have shown that a lowering of the temperature of the corrosion medium in dynamic corrosion testing to 40° C. substantially raises the resistance of the sheet covering material. Therefore the sheet covering temperature should be lowered by an additional internal insulation from the previously usual 80° to over than 160° C. down to at least 60° C., preferably to 50° to 30° C. and to about 40° C. for special advantages.

An advantageous embodiment of the invention consists of the fact that according to the purpose intended, two different steel groups are used for the sheet covering of the blast preheater, which differ essentially in the alloy content of carbon, molybdenum and in their mechanical properties. The first steel group contains e.g. the following components: 0.005 to 0.2% carbon, 0.1 to 1.5% silicon, 0.1 to 2% manganese, max. 0.025% phosphorus, max. 0.025% sulfur, 0.1 to 2.0% molybdenum and for the remainder iron and the inevitable impurities. These steels possess a fracture expansion of about 30% and should be particularly used for the assembly and design of new installations or self-supporting double jackets. The steels 15Mo3 and 16Mo5 are examples of such steels in these groups.

The second suitable steel group contains e.g. the following components and is distinguished by a fracture expansion of $\geqq$40%: 0.005 to 0.1% carbon, traces of silicon, max. 0.4% manganese, 0.01 to 0.15% molybdenum, max. 0.025% phosphorus, max. 0.025% sulfur, max. 0.007% nitrogen, max. 0.2% titanium while the remainder is iron and the inevitable impurities. This alloy is to be preferred for repairs in which the old steel jacket takes over the supporting structure and high strengths for the repair materials are not necessary(% in all cases means % by weight).

Heat exchangers, especially blast preheaters (or cowpers) are subjected in operation to cyclic loading. The tensions predominant in the installation caused by the system on the one hand and by the processing of the material on the other are marked by the fact that the system undergoes a change in tension and in expansion, when pressure-loaded or unloaded, whereby the magnitude of the expansion rates is of decisive importance to the mechanism of the corrosion process. Thus in high temperature blast preheaters, which are operated at a maximum of 4 bar of pressure, expansion rates of the order of $10^{-6}$ to $10^{-8}$ $s^{-1}$ are measured. These expansion rates are system-inherent and a change from outside is not possible if we disregard the fact that pressure fluctuations and thus the expansion amplitudes can be reduced. This cylical loading superposes a static fundamental tension in the component which is essentially caused by the inherent tensions which arise in the area of the welding seam. Therefore according to the invention, efforts are made to keep the inherent welding tensions in the material as low as possible, by using homogenous welding, a multiple-pass heat-treatable welding is carried out in such manner that the structure formed after the welding does not have any great differences in hardness between the basic material and the area of the welding seam, and thus it has low inherent tension.

The necessary and rational combination of loading, material and electolyte is further attained according to the invention in that the refractory material of the insulating layer is so arranged and dimensioned that the temperatures of the sheet covering are at most 60° C., preferably a maximum of 40° C., with any roof temperature and any design of the blast furnace, the boiler or of the high-temperature blast preheater (or cowper). To maintain the predetermined temperature of the sheet covering at for example higher ambient temperatures a water-jet scrubbing installation can be provided on the heat exchanger. To reduce the heating effects of the sun's rays, the sheet covering of the invention can be provided with a reflecting layer.

Further according to the invention efforts are made to build the insulating layer between the refractory material and the sheet covering of refractory bricks, especially bricks having a high resistance to moderately acidic nitrate electrolytes.

Further features and advantages of the invention are shown in the drawing and the relevant specification. Examples of embodiments of the invention are shown in the drawings. They show:

FIG. 1: the design of a welded seam and a table with welding data,

FIG. 2: a graphic illustration of the hardness profile in the welded seam area, FIG. 3: a graphic illustration of the tensions gradient in the sheet covering when pressure changes take place in the blast preheater (or cowper), FIG. 4: a graphic illustration of the influence of the molybdenum content of the sheet covering on the service life, FIG. 5: a graphic illustration of the influence of the temperature of the corrosion medium on the service life FIG. 6: a schematic illustration of the design of a blast preheater (or cowper) according to the invention.

FIG. 1 contains examples of good and bad welds which may lead to rapid damage as regards intercrystalline tension crack corrosion or on the other hand have a long service life. In the case of the STE 36 with a hardness difference between the basic material and the welded seam of 120 MV, there was clearly intercrystalline tension crack corrosion in the area of the welded seam.

With welded samples of 15Mo3 and a comparative sample of steel ASt 41, the maximal hardness differences of 50 to 60 MV were measured, as can be seen from FIG. 2. According to the invention the welding should be carried out so that a hardness difference between the basic material and the welded seam area should not exceed 50 to 60 MV.

The loading gradient according to FIG. 3 is such that a static inherent tension baseload which is variable is superposed by a dynamic top load. This loading is system-inherent and cannot be altered. For the system selection of the invention it is important that the expansion rate of the system, when changing from pressure to unloading or vice-versa is within the order of magnitude between $10^{-6}$ and $10^{-8}s^{-1}$. With a cyclical loading process and critical expansion rates there was a clear influence of the molybdenum content on the sensitivity to intercrystalline tension crack corrosion of the sheet covering under conditions of dynamic loading.

FIG. 4 shows the favorable influence of molybdenum on the service life of the steels of the invention at constant expansion rates from $3.3 \cdot 10^{-7} s^{-1}$ for the steels H II,X67, 15Mo3 and 16Mo5. This makes the increase of the service life according to the invention clearly visible with rising molybdenum content.

The formation of stable passive layers in steels is closely connected with the steel composition, especially with the content of molybdenum. For this reason molybdenum is the essential component of the sheet steel of the invention. In contrast to the sheet steel of U.S. Pat. No. 4,222,772, in which chromium is regarded as an essential component. under the predetermined conditions of the process, by dynamic and low frequency loading at constant expansion rates it is found that the presence of chromium has negative consequences for the susceptibility to intercrystalline tension crack corrosion. Such sheet steels have a chromium reduction in the area of the welded seams which can be prevented by the addition of carbon and nitrogen-setting elements such as niobium. This measure of chromium-bonding and thereby the avoidance of a chrome reduction becomes unnecessary in the case of pure molybdenum steels.

The influence of the temperature is clear from FIG. 5. Here it is shown that with a reduction of the sheet covering temperature to values below about 60° C. and with equally dynamic loading, service lives are attained such as are also found in a neutral medium using glycerol. Thus, in this case there is almost a purely mechanical behavior.

FIG. 6 shows the schematic design of an embodiment of a blast preheater (or cowper) according to the invention. Here 1 is the steel jacket, 2 the inner insulating layer, and 3 is the refractory lining (interior).

We claim:

1. A heat exchanger having an inner refractory lining, an intermediate insulating layer and an outer metal shell, said insulating layer being disposed to maintain the temperature of said metal shell in the range of from 20°–60° C. during the operation of said heat exchanger, said metal sheel comprising an essentially chromium-free structural steel having a molybdenum content in the range of from 0.01 to 2% by weight.

2. The heat exchanger of claim 1 wherein said essentially chromium-free strutural steel has a high stability against stress corrosion cracking induced by cyclic low-frequency loading in the presence of nitrogen compounds.

3. The heat exchanger of claim 1 or 2 wherein said insulating layer maintains said metal shell at a temperature in the range of from 30° to 50° C.

4. The heat exchanger of claims 1, 2 or 3 wherein said essentially chromium-free structural steel is essentially free of vanadium.

5. The heat exchanger of claim 1 wherein said metal shell is steel consisting essentially of 0.005 to 0.2% carbon, 0.1 to 1.5% silicon, 0.1 to 2.0% manganese, 0.025% or less phosphorous, 0.025% or less sulfur, 0.1 to 2.0% molybdenum, the remainder being iron and incidental impurities.

6. The heat exchanger of claim 1 wherein said metal shell consists of steel with 0.005 and 0.1% carbon, trace amounts of silicon, 0.4% or less manganese, 0.025 or less phosphorous, 0.025% or less sulfur, 0.01 to 0.15% molybdenum, 0.007% or less nitrogen, 0.2% or less titanium, with the remainder being iron and incidental impurities.

7. The heat exchanger of claims 1, 2, 3, 4, 5 or 6 wherein welds in said metal shell have essentially the same composition as said shell thereby eliminating need for stress relief annealing of such shell.

8. The heat exchanger according to any of claims 1, 2, 3, 4, 5, 6 or 7 wherein said insulating layer is comprised of refractory bricks.

9. The heat exchanger according to any one of claims 1, 2, 3, 4, 5, 6, 7 or 8 wherein said insulating layer is comprised of refractory bricks having a high stability against moderately acidic nitrate or nitrite electrolytes.

10. The heat exchanger of any one of claims 1, 2, 3, 4, 5, 6, 7, 8 or 9 wherein said insulating layer is disposed to maintain said metal shell at a temperature of no more than about 40° C.

11. The heat exchanger of any one of claims 1, 2, 3, 4, 5, 6, 7, 8, 9, or 10 wherein said heat exchanger includes means for cooling said metal shell with water.

12. The heat exchanger of any one of claims 1, 2, 3, 4, 5, 6, 7, 8, 9, 10 or 11 wherein the outer surface of said metal shell includes means for reflecting solar radiation.

13. A process for increasing the temperature of gas to be input to a blast furnace wherein said gas is introduced under pressure to the heated interior of a heating apparatus, said apparatus including an interior refractory lining, an intermediate insulating layer and an outer metal shell consisting essentially of a chromium-free structural steel having a molybdenum content of from 0.01 to 2% by weight, said process comprising the steps of:

(a) passing said gas through said apparatus; and
(b) controlling the temperature of the metal shell such that it remains below about 60° C. by means of insulation provided by said intermediate insulating layer.

14. A process for heating of high-pressure air in an apparatus comprised of an inner refractory lining, an intermediate insulating layer and an outer metal shell, said metal shell consisting essentially of a structural steel essentially free of chromium with a molybdenum content of 0.01 to 2% by weight, said process comprising the steps of:

(a) heating the interior of said apparatus;
(b) introducing gas to the interior of said apparatus at pressures greater than atmospheric, said gas being heated by its contact with said inner lining; and
(c) controlling the temperatures of said metal shell such that it remains below about 60° C.

15. The process of claim 14 wherein said metal shell is kept at a temperature below about 40° C.

16. The process of claim 14 wherein the temperature of said metal shell is controlled by the dimensions and thermal conductivity of the intermediate insulating layer.

17. The process of claim 14 wherein the temperature of the metal shell is controlled by introduction of water to said metal shell.

* * * * *